United States Patent [19]

Heinonen

[11] Patent Number: 4,842,080

[45] Date of Patent: Jun. 27, 1989

[54] ARRANGEMENT FOR MOUNTING OF A ROTATION ELEMENT IN A DRILLING MACHINE

[75] Inventor: Jarmo Heinonen, Tampere, Finland

[73] Assignee: Oy Tampella AB, Tampere, Finland

[21] Appl. No.: 43,841

[22] Filed: Apr. 28, 1987

[30] Foreign Application Priority Data

May 9, 1986 [FI] Finland ..... 861941

[51] Int. Cl.[4] ..... B23B 45/16

[52] U.S. Cl. ..... 173/105

[58] Field of Search ..... 173/105, 104, 109, 111; 74/434

[56] References Cited

U.S. PATENT DOCUMENTS 4,157,121 6/1979 Antsberg et al. ..... 173/105 X
4,206,820 6/1980 Bailey et al. ..... 173/105

FOREIGN PATENT DOCUMENTS 0035005 2/1980 European Pat. Off. .
1507605 4/1978 United Kingdom .

OTHER PUBLICATIONS

U.S. Ser. No. 517,779.

*Primary Examiner*—Frank T. Yost
*Assistant Examiner*—Willmon Fridie, Jr.
*Attorney, Agent, or Firm*—Ladas & Parry

[57] ABSTRACT

An arrangement for mounting of a rotation element in a drilling machine comprising a body (1) and a rotation element (8) mounted by means of bearing surfaces (8*a*, 8*b*) rotatably in the body for rotation of a drill shank (9). The rotation element is rotated by a rotation machinery (10) in engagement with a gear ring (11) of the rotation provided in the rotation element between the bearing surfaces. In order to replace the rotation element without having to disassemble the body, the rotation element is mounted at both ends thereof in the radial direction in an integral body part (3), and the bearing surfaces and the gear ring are arranged in a stepped manner so that the rotation element is removable from the integral body part axially through one end (3*c*) thereof.

3 Claims, 1 Drawing Sheet

ARRANGEMENT FOR MOUNTING OF A ROTATION ELEMENT IN A DRILLING MACHINE

Figure 1:
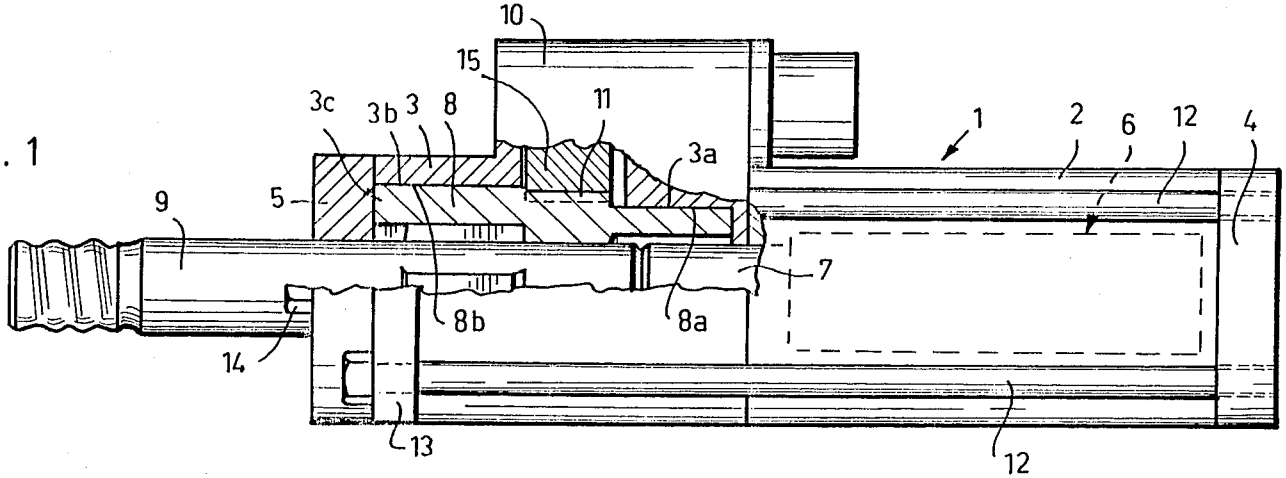

This invention relates to an arrangement for mounting of a rotation element in a drilling machine comprising a body and a percussion means mounted therein, a rotation element mounted rotatably in the body as an axial extension of the percussion means, and a rotation machinery supported by the body, which rotation machinery is in rotational engagement with the rotation element.

The term "rotation piece" as used herein refers both to a frame bushing used for rotation of a shank portion formed at the end of a drill rod and to a rotation bushing used for rotation of a special drill shank to be fastened to a drill rod.

In conventional hydraulic percussion drilling machines a percussion means mounted in the body is intended to direct successive axial percussions on a drill shank simultaneously as the shank is being rotated by means of a rotation element. For this purpose the rotation element is mounted rotatably in a supporting housing provided in the body.

In known drilling machine constructions the rotation element is mounted in two or more body parts, so that the supporting housing comprises at least two parts. These body parts and the other parts of the body are interconnected by tie rods to form an rigid unit. It is common practice in mechanical engineering to position one of two bearings of a rotating shaft in a detachable part when a gear ring, for instance, is positioned between the two bearings of the shaft.

However, the known construction has the major disadvantage that the tie rods of the body parts have to be opened for replacement of the rotation element. In addition, the accuracy of the mounting of the rotation element is not the best possible since the bearings are positioned in two separate body parts.

The object of the present invention is to provide an arrangement for mounting of a rotation element, which arrangement avoids the above disadvantages and enables the rotation element to be replaced in a simpler manner. This object is achieved by means of the arrangement according to the invention which is characterized in that the rotation element is at both ends thereof mounted in the radial direction in an integral body part, and that bearing surfaces of the rotation element and a gear ring provided therebetween are arranged in a stepped manner so that the rotation element is removeable from said body part axially through one end thereof.

The invention is based on the idea that the bearing arrangement between the rotation element and the supporting housing is so shaped that the rotation element can be detached from an integral body part without having to disassemble the bearing surfaces provided in the supporting housing. By virtue of the integral body part the sideward forces acting on the shank can be transmitted through the rotation element to one rigid body part. The rotation element can be checked and serviced rapidly, since the integral rotation element can be drawn axially out of the supporting housing through one end thereof without having to disassemble the supporting housing. The detachment of the rotation element from the body does not, either, require an opening of the tie rods of the body, because it is not necessary to disassemble the body into separate parts.

Figure 2:
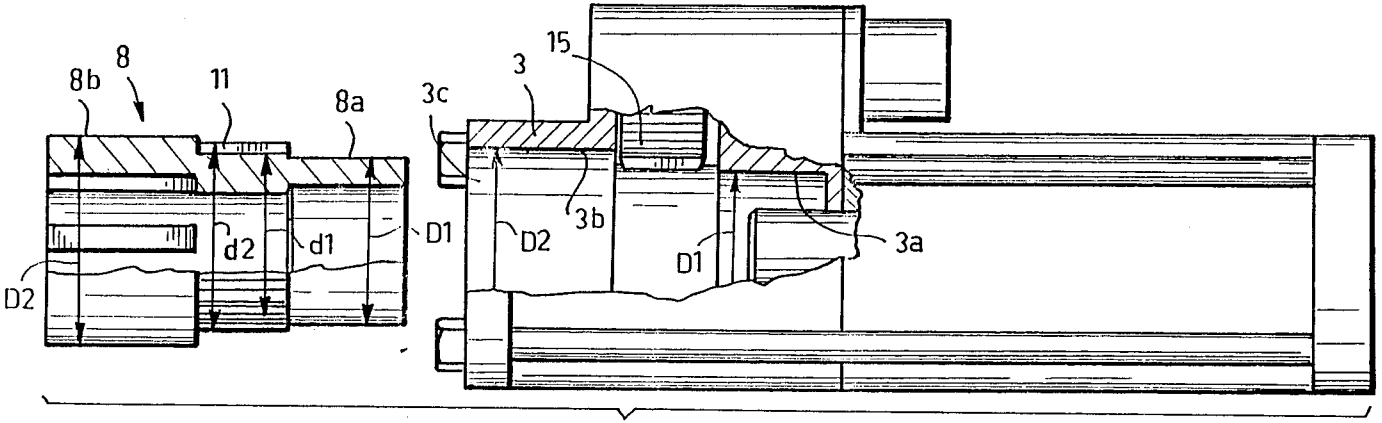

The invention will be described in more detail in the following with reference to the attached drawing, wherein FIG. 1 illustrates schematically a drilling machine provided with an arrangement according to the invention as a partial axial section in a side view, and FIG. 2 illustrates a rotation element and a body as disassembled.

The drilling, machine shown in the drawing comprises a body 1 comprising a rearward body part 2 and a forward body part 3 and end covers 4, 5. A percussion means 6 is mounted in the rearward body part, and the percussion means is provided with a percussion piston 7. A rotation bushing 8 is mounted rotatably in the forward body part, and a shank 9 is mounted unrotatably but axially slideably within the rotation bushing coaxially with the percussion piston. The body supports a rotation machinery 10 which is in rotational engagement with a gear ring 11 provided on the outer surface of the rotation bushing. The body is assembled into a rigid unit by means of longitudinal tie rods 12 which extend from lugs 13 provided at the front end of the forward body part to the rear cover 4. The front cover is attached to the body part 3 by means of fastening screws 14 of its own.

The forward body part forms a supporting housing for the rotation bushing and it is provided with axially spaced bearing surfaces 3*a* and 3*b* which function as slide bearings for bearing surfaces 8*a* and 8*b* respectively provided at both ends of the rotation bushing. The bearing surfaces of the rotation bushing are positioned on opposite sides of the gear ring.

According to the invention both bearing surfaces and the gear ring of the rotation bushing are stepped in such a manner that the diameter D1 of the inner bearing surface 8*a* is smaller than or at the most equal to the inner diameter d1 of the gear ring, and the diameter D2 of the outer bearing surface is at least equal to or larger than the outer diameter d2 of the gear ring. By virtue of such a stepping the rotation bushing can be removed from the body part through a front opening 3*c* thereof without having to disassemble a drive gear 15 of the rotation machinery. Only the front cover 5 has to be opened for replacement of the rotation bushing; the tie rods need not be opened.

It is further noted that the body part 3 acting as a supporting housing is formed by an integral piece, on account of which the supporting housing is rigid and the mounting is accurate.

The drawing and the description related thereto are only intended to illustrate the idea of the invention. In its details the arrangement may vary within the scope of the claims.

I claim:

1. A mounting for a rotation element in a drilling machine comprising:

a body having an end cover removably fastened to the body by fastening means;

percussion means mounted within said body;

a rotation element mounted rotatably with said body in an integral body part in axial alignment with said percussion means;

rotation means supported by the body and in rotational engagement with a gear ring on said rotation element for rotating said rotation element;

first and second bearing surfaces on said rotation element, said first bearing surface being located on a side of said rotation element nearest said percussion means, said second bearing surface being located on a side of said rotation element nearest said end cover, said first bearing surface, said gear ring and said second bearing surface being arranged in a stepped manner whereby said rotation element is axially removable from said body part by removing only said end cover.

2. The mounting according to claim 1 wherein a diameter of said first bearing surface is not greater than an inner diameter of said gear ring and a diameter of said second bearing surface is not less than an outer diameter of said gear ring.

3. The mounting according to claim 2 wherein said body comprises separate body parts interconnected by means of tie rods, said end cover being attached to said integral body part.

* * * * *